US006405690B1

(12) United States Patent
Eder

(10) Patent No.: US 6,405,690 B1
(45) Date of Patent: Jun. 18, 2002

(54) AIR-COOLED INTERNAL COMBUSTION ENGINE WITH A CRANKSHAFT WHICH ROTATES ABOUT A VERTICAL AXIS, ESPECIALLY A SINGLE CYLINDER DIESEL MOTOR

(75) Inventor: Erich Eder, Vornbach/Inn (DE)

(73) Assignee: Motorenfabrik Hatz GmbH & Co., KG, Ruhstorf/Rott (DE)

( * ) Notice: Subject to any disclaimer, the term of this patent is extended or adjusted under 35 U.S.C. 154(b) by 0 days.

(21) Appl. No.: 09/647,263

(22) PCT Filed: Mar. 29, 1999

(86) PCT No.: PCT/EP99/02126

§ 371 (c)(1),
(2), (4) Date: Dec. 8, 2000

(87) PCT Pub. No.: WO99/50542

PCT Pub. Date: Oct. 7, 1999

(30) Foreign Application Priority Data

Mar. 27, 1998 (DE) ..... 198 13 624

(51) Int. Cl.[7] ..... F02B 75/16; F02B 75/00; F01P 5/06

(52) U.S. Cl. ..... 123/41.56; 123/41.65; 123/41.7

(58) Field of Search ..... 123/41.56, 41.63, 123/41.65, 41.7, 41.69

(56) References Cited

U.S. PATENT DOCUMENTS

| | | | |
|---|---|---|---|
| 2,516,312 | A | 7/1950 | Ginn |
| 2,875,745 | A | 3/1959 | Van Ranst |
| 3,183,899 | A | 5/1965 | Tuggle |
| 4,432,309 | A | 2/1984 | Hutchison et al. |
| 4,540,888 | A | 9/1985 | Drewry et al. |
| 4,890,584 | A | 1/1990 | Tamba et al. |
| 4,964,378 | A | 10/1990 | Tamba et al. |
| 5,000,126 | A | 3/1991 | Isaka et al. |

FOREIGN PATENT DOCUMENTS

| | | | |
|---|---|---|---|
| DE | 2439808 | * | 3/1976 |
| DE | 2 399 200 | | 3/1979 |
| DE | 198 13 624 A1 | | 1/1990 |

OTHER PUBLICATIONS

English translation of the first page of the German article entitled *The Air Cooling System of the New Gueldner Diesel Engines–Series L 79*, by Hans Barth, pp. 39–54, Published 6/1963, Berichie Aus Technik und Wissenschaft.

* cited by examiner

*Primary Examiner*—Noah P. Kamen
(74) *Attorney, Agent, or Firm*—Van Dyke, Gardner, Linn & Burkhart, LLP

(57) ABSTRACT

An air cooled internal combustion engine with a crankshaft that rotates about a vertical axis is provided. The engine may be a single cylinder diesel motor. The internal combustion engine includes an encapsulation which surrounds a plurality of cooling air channels. A flywheel is positioned at the top end of the crankshaft and is combined with a radial blower. An air distribution housing, which is joined to a top front wall of the crank case, forms a pressure chamber of the radial blower. At least two substreams of cooling air branch off from the pressure chamber. A first substream is guided through the housing encapsulation, which surrounds the cylinder and the cylinder head. A second substream is guided in a lining on the outside of the sidewall of the crankcase and the oil pan facing the cylinder. Both substreams are collected on the downstream side and exit through a common air-extractor shaft.

7 Claims, 1 Drawing Sheet

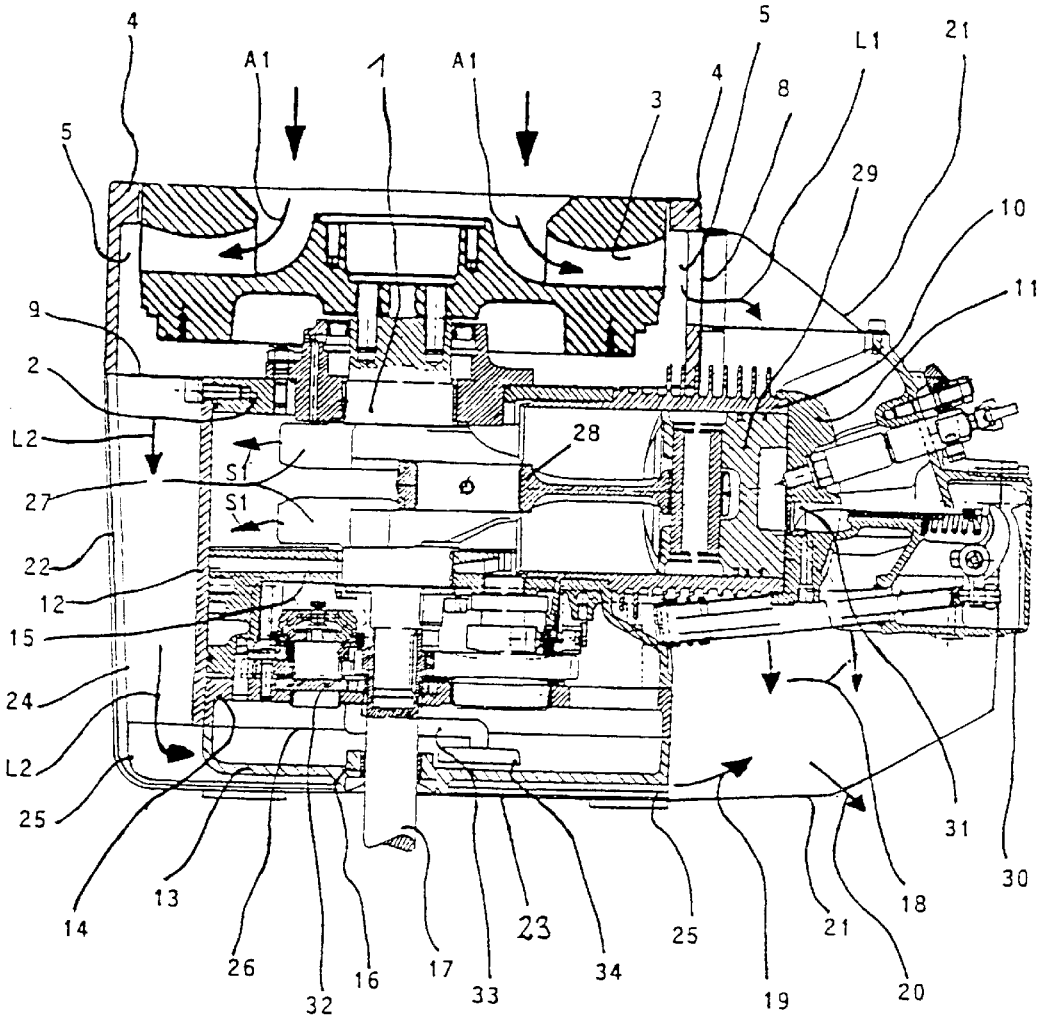
4
5
A1
1
A1
3
4
5
8
L1
21
29
10
11
9
2
L2
28
S1
27
S1
22
12
15
24
L2
25
14
13
26
32
16
17
33
23
34
25
19
21
20
18
31
30

AIR-COOLED INTERNAL COMBUSTION ENGINE WITH A CRANKSHAFT WHICH ROTATES ABOUT A VERTICAL AXIS, ESPECIALLY A SINGLE CYLINDER DIESEL MOTOR

The invention relates to air-cooled internal combustion engines, and in particular to a single cylinder diesel engine that is provided with a crankshaft which rotates about a vertical axis and has a capsule type casing that surrounds the cooling air channels.

In the case of air-cooled engines where the shaft runs vertically in the mounting position, one usually finds that these are Otto carburetor engines for special applications, e.g., to drive lawn mowers, agricultural equipment, or similar machines. These vertical shaft engines often omit a reverse gear, but allow the height of a piece of equipment into which they are incorporated to be especially low. Usually, such engines are not designed for continuous duty; their power range usually being between 2 and 5 kW.

Known small diesel engines for industrial applications are usually standing motors, i.e. units which have a crankshaft that rotates about a horizontal axis in the mounting position, and are units of robust construction, suitable for multifunctional applications, and which often are provided with noise-inhibiting casings to protect the environment against excessive noise emission. Where single cylinder diesel engines are concerned, the power range of industrial diesel engines of this type have an upper limit of approx. 12 kW, at a working volume of 700 to 750 $cm^3$.

In the case of an oil-cooled single cylinder engine, (as described in U.S. Pat. No. 4,964,378), a partial enclosure is provided for additional air cooling. A cooling air blower at the upper end of the crankshaft serves to divert a cooling air stream, which is led along the ribs of the crankcase enclosure; a second cooling air stream is channeled through a capsule type casing that surrounds the cylinder and the cylinder head. The two cooling air streams are evacuated separately. On the bottom surface of the enclosure, where the lower end of the crankshaft is located, a capsule type enclosure of the engine housing is omitted. In this area, the cooling is accomplished solely by the oil in combination with the housing's ribbed walls. Such a motor is therefore dependent on a combination of air and oil cooling, which translates into high manufacturing costs.

BRIEF DESCRIPTION OF THE DRAWINGS

FIG. 1 is a cross-section of an engine according to one embodiment of the present invention taken along the engine's vertical axis.

DESCRIPTION OF THE PREFERRED EMBODIMENTS

The objective of the present invention is to create a horizontally mounted diesel motor that is provided with a vertical shaft and that is suitable for industrial applications. The invention is particularly suitable for applications where a low height or a low center of gravity is important. The invention, however, is universally applicable, meaning that it has power take-off points at both end faces of the engine's casing, and is suitable for having diverse hydraulic pumps and drive units connected to it. Furthermore, the invention is provided with an efficient engine cooling system, even when it is executed with an enclosure, and it has relatively low manufacturing costs.

According to one embodiment of the invention, an engine in the form of a single cylinder diesel engine with a vertical shaft that has the cited characteristics is provided. This engine solves the above-noted problems. The engine's air supply is effected by a flywheel-driven cooling blower whose outstanding feature is that it provides a sufficient amount of cooling air, which—via an air distribution housing that surrounds the flywheel-fitted cooling blower and at the same time forms the connector housing—is distributed to a dual air stream cooling system. In this manner, two cooling air sub-streams are diverted from the delivery (pressure) side of the air distribution housing; one of the streams is guided over the cylinder and cylinder head portion and thus cools those engine components which, due to the combustion process, have been loaded with process-produced heat or have come into direct contact with hot exhaust gases. The other air cooling sub-stream serves to cool the engine oil that is applied to the motor as a lubricating and cooling agent. For this purpose, this cooling partial air stream is guided around the crankshaft housing and along the oil pan at the bottom surface of the motor housing.

The two cooling air sub-streams—with a distribution ratio of approx. 2:1, where the smaller sub-stream is sufficient to cool the oil—are finally collected in a common extractor shaft and then exit from there to the outside.

In a conventional manner, the first cooling air sub-stream is channeled essentially through a housing capsule that envelops the cylinder and the cylinder head, causing the two sub-streams—which are led together again at the discharge side—to flow around these two components.

Initially, the second sub-stream of cooling air is led beneath a sheathing at the ribbed outer sides, along a side wall of the crankcase, and then along the oil pan, with the side wall matching the bottom of the crankcase (in the case of a vertical engine), and where the oil pan is joined to its underside which is formed by the outer wall of the engine's control housing.

Within the scope of the invention, an especially simple union of the cowling of the engine is achieved by the fact that the air streams flow into a common air extractor shaft on the downstream or discharge side, from where they are diverted to the outside.

For a horizontal engine of this type, it may be convenient to manufacture it with a special motor housing; it may prove more cost-efficient, however, to utilize an already existing engine housing, and to add special components to it.

One such special component is a novel oil pan with cooling ribs on its outside, and with connection elements for a leak-proof connection to an existing control housing. On the side of the control housing, where—among others—the control unit and the oil pump are placed, it may be convenient to make certain modifications for connecting the oil pan.

Another special component is created in the form of a cooling ribs-carrying component, which is screwed onto as large of a common contact area as possible at the outside of the lateral wall of the crankcase.

The aforementioned components serve as an aid in transferring heat from the crankcase and the oil pan to the second cooling air sub-stream, which is channeled under a corresponding sheathing via the ribbed components. The components are intended to reduce weight and, because of aluminum's good thermal conductivity, they are preferably made of this metal. An especially advantageous cooling effect results from the horizontal positioning of the engine and, in particular, due to the fact that the crankcase's cooled side wall, beneath which—in the case of a vertical engine— the oil sump is located, the inner side of the side wall receives a large charge of squirted oil. This helps produce an especially advantageous heat transfer.

This improved heat transfer and the advantageous channeling of the two substreams of cooling air over suitably ribbed components—which, apart from the ribbed components that are present next to the cylinder and cylinder head, also refer to the cited special components—allow the oil temperature to be reduced by up to 35° C., as compared to the temperature of a similar but vertically installed motor; this is based on a total air intake amount of approx. 10 $m^3$/min.

Due to the especially efficient air cooling and the especially low oil temperature of the present invention, it is possible to realize applications with the oil being under a high permanent load, and under extreme environmental conditions at long operating periods. This results in a desirable lengthening of the periods between maintenance.

FIG. 1 depicts a vertical section of a single cylinder diesel engine in its normal installation position, in which the axis of the crankshaft 1 proceeds vertically. In connection with the crankshaft 1, the balancing masses 27, as well as a connecting rod 28 with a piston 29 can be seen. The cylinder 10 with the corresponding cooling ribs is shown diagrammatically around piston 29; the cylinder head 11 is seated on the cylinder 10. A valve 31 can be seen inside the cylinder head cover 30.

The crankshaft 1 is supported in corresponding bearings of the upper (2) and lower (15) front wall of the crankcase. A flywheel in the form of a radial blower 3 is attached to the upper end of the crankshaft 1; the radial blower 3 is arranged on the inside of an air distribution housing 4. The air distribution housing 4 is affixed to the outside of the upper front wall 2 of the crankcase. It forms a pressure chamber 5 around the blower rotor. The intake air, flowing in between the blower vanes as per the arrows A1, arrives—as a first cooling air sub-stream L1—via the pressure chamber 5 and through an opening 8 in a housing capsule 21, that surrounds the cylinder 10 and the cylinder head 11. A second cooling air sub-stream L2 travels from the pressure chamber 5 and its opening 9 to cooling air shafts with a lateral sheathing 22 and inside a lower sheathing 23. The second cooling air sub-stream L2 flows behind the lateral sheathing 22 between the ribs 24 of the lateral wall 12 of the crankcase, which as per the arrows S1, receives a large charge of squirted oil on its inside. The second cooling air sub-stream L2 continues to flow between the ribs 25 of the oil pan 13, which is affixed to the outer wall of the control housing 26. The control housing 14 contains an oil pump 32, which is connected to the oil pan 13, which, in turn, is connected to the oil sump via an intake line 33 with a filter 34. The squirted oil is returned to the oil pan via corresponding oil return openings in the lower front wall 15 of the crankcase, and then via the oil-permeable control housing 14. In the area of the shaft bearing 16, at the driven end (power take-off side) in which the crankshaft extension 17 runs on bearings, the ribs 25 of the oil pan 13 extend laterally around this bearing site, though without interrupting the air stream. As per arrow 19, the second cooling air sub-stream L2 leaves the ribs 25 of the oil pan 13 and joins the first cooling air sub-stream L1 inside the housing capsule 21 at its outlet side where—as per the arrows 18—the first cooling air sub-stream discharges. From this point on, the reunited cooling air sub-streams flow to the outside through an air extractor shaft, as shown by arrow 20.

FIG. 1 further shows that the first cooling air sub-stream L1 splits into two branch air streams while it flows around the cylinder 10 and the cylinder head 12, before it exits from the air extractor shaft (as per arrow 20) together with the second cooling air sub-stream L2. Thus, the two cooling circuits describe stream travel paths which essentially proceed parallel to the drawing plane, before they come together in the extractor shaft, from which they exit in the direction of the arrow 20. There is no (air) circulation around the engine housing at a level that is vertical to the drawing plane; this is self-explanatory in view of the known construction of such motors.

What is claimed is:

1. An air-cooled internal combustion engine comprising:

a cylinder having a head;

a crankshaft that rotates about a vertical axis;

a radial blower at an upper end of the crankshaft;

a control cover at the lower end of the crankshaft;

an oil pan attached to the outside of the control cover;

a housing capsule that surrounds the cylinder and the cylinder head;

an air distribution housing joined to an upper wall of a crankcase, said air distribution housing forming a pressure chamber of the radial blower;

a first cooling air sub-stream which branches off from the pressure chamber and which is guided through the housing capsule; and, a second cooling air sub-stream which branches off from the pressure chamber and which is guided within a first sheathing at the outside of a lateral wall of the crankcase, said second cooling air sub-stream guided within a second sheathing at the outside of the oil pan;

wherein said first and second air cooling sub-streams exit through a common air extractor shaft that is continuous with a downstream side of the interior of the housing capsule.

2. The internal combustion engine of claim 1, wherein the first cooling air sub-stream is divided, by the cylinder and the cylinder head, into two branch streams, which flow around the cylinder and the cylinder head, said branch streams being brought together again at the downstream side.

3. The internal combustion engine of claim 2, further including a separate member screwed onto the outside of the lateral wall (12) of the crankcase, separate member forming cooling ribs (24) and having a large common contact area.

4. The internal combustion engine of claim 1, wherein the second cooling air sub-stream (L2) is divided by the down-drive-side shaft bearing (16) into two branch streams, the branch streams being guided along sides of the shaft bearing, the branch streams being brought together again at the down-stream side.

5. The internal combustion engine of claim 1, wherein the pressure chamber in the air distribution housing has a peripheral channel inside its lateral outer contour, said channel having lateral outlet apertures (8, 9) for the first and second cooling air sub-streams.

6. The internal combustion engine of claim 1, further including coating ribs inside the first and second sheathings for the second cooling air sub-stream said cooling ribs located on the lateral wall of the crankcase and/or on the outer side of the oil pan said cooling ribs oriented in the flow direction.

7. The internal combustion engine of claim 1, wherein the oil pan is designed as a separate component, which is provided with cooling ribs on its outside, and with connection elements for a leak-proof connection to the outer wall of the control cover housing.

* * * * *

UNITED STATES PATENT AND TRADEMARK OFFICE

CERTIFICATE OF CORRECTION

PATENT NO. : 6,405,690 B1
DATED : June 18, 2002
INVENTOR(S) : Erich Eder

It is certified that error appears in the above-identified patent and that said Letters Patent is hereby corrected as shown below:

Column 4,
Line 32, delete “continuous” and insert -- contiguous --.

Signed and Sealed this

Eighth Day of April, 2003

JAMES E. ROGAN
*Director of the United States Patent and Trademark Office*